United States Patent [19]

Grusha

[11] Patent Number: 4,634,054

[45] Date of Patent: Jan. 6, 1987

[54] SPLIT NOZZLE TIP FOR PULVERIZED COAL BURNER

[75] Inventor: John Grusha, Windsor Locks, Conn.

[73] Assignee: Combustion Engineering, Inc., Windsor, Conn.

[21] Appl. No.: 712,454

[22] Filed: Mar. 14, 1985

Related U.S. Application Data

[63] Continuation of Ser. No. 487,552, Apr. 22, 1983, abandoned.

[51] Int. Cl.[4] ..... F23K 3/02

[52] U.S. Cl. ..... 239/423; 239/498; 239/522

[58] Field of Search ..... 239/552, 498, 502, 512, 239/522, 524, 589, 590.5, 549, 418, 423, 424, 502, 512, 522, 521; 110/263

[56] References Cited

U.S. PATENT DOCUMENTS

| | | | |
|---|---|---|---|
| 2,363,875 | 11/1944 | Kreisinger et al. | 110/263 |
| 3,895,759 | 7/1975 | DePalma | 239/498 |
| 4,252,069 | 2/1981 | McCartney | 110/265 |
| 4,304,196 | 12/1981 | Chadshay et al. | 110/263 |

FOREIGN PATENT DOCUMENTS

| | | | |
|---|---|---|---|
| 504814 | 7/1930 | Fed. Rep. of Germany . | |
| 913092 | 4/1954 | Fed. Rep. of Germany . | |
| 127792 | 10/1977 | Fed. Rep. of Germany . | |
| 735519 | 8/1955 | United Kingdom | 239/552 |

*Primary Examiner*—Joseph F. Peters, Jr.
*Assistant Examiner*—Kevin Patrick Weldon
*Attorney, Agent, or Firm*—William W. Habelt

[57] ABSTRACT

An improved nozzle tip (30) which provides enhanced ignition and stabilization of pulverized fuel flames in furnaces operating at low load. The nozzle tip (30) comprises open-ended inner and outer shells (32,34) mounted to the fuel delivery pipe (12) and defining a flow passageway within the inner shell through which the pulverized fuel is directed into the furnace and an annular flow passageway (50) between the inner and outer shells through which additional air is directed into the furnace. A pair of diverging splitter plates (41,42) are disposed within the inner shell (32) so as to divide the flow passageway therethrough into two separate, diverging subpassages (52,54) so that the pulverized fuel stream discharging from the fuel delivery pipe is split into first and second streams (60,70) which pass from the nozzle tip (30) into the furnace in a diverging manner thereby establishing an ignition stabilizing pocket in the low pressure zone (80) created between the diverging fuel streams.

4 Claims, 6 Drawing Figures

SPLIT NOZZLE TIP FOR PULVERIZED COAL BURNER

This application is a continuation of application Ser. No. 487,552, filed Apr. 22, 1983, and abandoned on Mar. 14, 1985.

BACKGROUND OF THE INVENTION

The present invention relates to improving the low load operation of fuel burners for use in pulverized coal-fired furnaces and, more particularly, to improving low load operation of fuel-air admission assemblies for directing a pulverized fuel-air mixture into the furnace by what is known as the tangential method of firing.

In view of today's fluctuating electricity demand, typified by peak demand occurring during weekday daytime hours and minimum demand occurring at night and on the weekends, electric utilities have chosen to cycle many of their conventional coal-fired steam generator boilers by operating them at full load during peak demand hours and reducing them to low loads during periods of minimum demand.

As a consequence of this mode of operation, the electric utilities have used large quantitites of natural gas or oil to furnish additional ignition energy during low load operation because the current generation from coal-fired steam generator furnaces require stabilization of the coal flames when operating at low loads. The required amount of auxiliary fuel fired for stabilization purposes is significant and, for example, to maintain a 500 megawatt coal-fired steam generator at 10 to 15 percent load during minimum demand periods could require the use of 11,000 gallons of oil per day.

One common method of firing a pulverized fuel such as coal in a conventional steam generator furnace is known as tangential firing. In this method, pulverized coal is introduced to the furnace in a primary air stream through burners, termed fuel-air admission assemblied, located in the corners of the furnace. The fuel-air streams discharged from these assemblies are aimed tangentially to an imaginary circle in the middle of the furnace. This creates a fireball which serves as a continuous source of ignition for the incoming coal. Each fuel-air admission assembly is comprised of a fuel delivery pipe through which pulverized fuel entrained in air passes to the furnace, a secondary air conduit surrounding the fuel delivery pipe through which additional air is introduced into the furnace, and a nozzle tip which is pivotally mounted to the outlet end of the fuel delivery pipe.

A typical nozzle tip comprises inner and outer shells disposed coaxially in spaced relationship thereby defining a first flow passageway within the inner shell through which the pulverized fuel and air mixture discharging from the fuel delivery pipe passes into the furnace and a second flow passageway in the annular space between the inner and outer shells through which the secondary air discharging from the secondary air conduit passes into the furnace. Typically, one or more splitter plates are disposed within the inner shell parallel to the axis of the nozzle tip to divide the flow passageway within the inner shell into multiple subpassages. The nozzle tip may be tilted upward or downward in order to direct the fuel-air mixture, discharging into the furnace from the fuel delivery pipe upwardly or downwardly as a means controlling the temperature of the superheated steam produced in heat exchange surface typically disposed at the outlet of the surface in the manner taught by U.S. Pat. No. 2,363,875.

During normal operation of a tangentially fired furnace, a flame is established at one corner which in turn supplies the required ignition energy to stabilize the flame emanating from the corner downstream of and alterally adjacent to it. When load is reduced, the flames emanating from each corner become shorter and, as a consequence, a reduction in the amount of ignition energy available to the downstream corner occurs. As a result, auxiliary fuel such as oil or natural gas must be introduced in each corner adjacent to the pulverized coal-air stream to provide additional ignition energy thereby insuring that a flameout and resultant unit trip will not occur.

Another problem associated with operating a coal-fired burner at low loads results in the fact that the pulverizing mills typically operate with a relatively constant air flow over all load ranges. When furnace load is reduce, the amount of coal pulverized in the mills decreased proportionally while the amount of primary air used to convey the pulverized coal from the mills through the admission assemblies into the furnace remains fairly constant, thereby causing the fuel-air ratio to decrease. When the load on the furnace is reduced to the low levels desired during minimum demand periods, the fuel-air ratio has decreased to the point where the pulverized coal-primary air mixture has become too fuel lean for ignition to stabilize without significant supplemental ignition energy being made available.

One way in which the need for auxiliary fuel firing during low load operation on coal-fired boilers can be reduced is presented in U.S. Pat. No. 4,252,069. This patent disclosed an improved fuel-air admission assembly incorporating a split coal bucket which permits a pulverized coal-fired furnace to be operated at low loads without use of auxiliary fuel to provide stabilization. As disclosed therein, the split coal bucket comprises independent upper and lower coal nozzles pivotally mounted to the coal delivery pipe, the upper and lower coal nozzles being independently tiltable. When the furnace is operating at low loads such as during the minimum demand periods, the primary air and pulverized coal stream discharing from the coal delivery pipe is split into an upper and a lower coal-air stream and independently directed into the furnace by tilting the upper coal nozzle upward and the lower coal nozzle downward. In doing so, an ignition stabilizing pocket is established in the locally low pressure zone created in the void between the spread apart coal-air streams. Hot combustion products are drawn, i.e., recirculated into this low pressure zoné, thus providing enough additional ignition energy to the incoming fuel to stabilize the flame.

An additional nozzle tip designed to improve ignition stability, albeit directed to the ignition of low volatile coal rather than ignition at low load operation, is presented in U.S. Pat. No. 2,608,168. Disclosed therein is a coal bucket pivotally mounted to the coal delivery pipe with the flow passageway defined within the inner shell bifurcated into two parallel but spaced apart flow subpassages. Secondary air is discharged into the furnace from the secondary air conduit surrounding the coal delivery pipe through the flow passageway between the inner and outer shells and through the central channel formed between the parallel but spaced apart subpassages formed within the inner shell. Ignition is said to be improved by increasing the contact area between the coal-air mixture discharged from the spaced flow passages of the inner shell and the bounding secondary air streams.

Despite the aforementioned nozzle tip designs, there still exists a need for a nozzle tip of a relatively simple design which inherently provides improved ignition stability at low load operation. There also exists a need for such a nozzle tip which is readily manufactured by fabrication and/or casting.

SUMMARY OF THE INVENTION

The present invention provides a novel tip for a burner on a pulverized fuel fired furnace which is particularly adapted to provide improved ignition stability during low load operation of the furnace. The nozzle tip of the present invention comprises an open-ended inner shell defining a flow passageway through which a mixture of pulverized fuel and transport air passes from the burner into the furnace, an open-ended outer shell spaced from and surrounding the inner shell thereby defining an annular flow passage therebetween through which additional air for combustion passes from the burner into the furnace, and plate means disposed within the inner shell for dividing the flow passageway therethrough into first and second flow passages which extend from the inlet of the inner shell to the outlet of the inner shell in a diverging manner with a void region established therebetween through which flow is precluded. The coal-air mixture discharging from the burner is split by the plate means into a first stream which is directed into the furnace through the first flow passageway through the inner shell and a second stream which is directed into the furnace through the second flow passageway of the inner shell. Thus, the coal-air mixture is directed into the furance in two diverging streams. In doing so, an ignition stabilizing pocket is established in the locally low pressure zone created between the spread-apart and diverging coal-air streams in the furnace just downstream of the void region established between the diverging first and second flow passageways through the inner shell of the nozzle tip. Coal is concentrated in this pocket and hot combustion products are drawn back into the pocket from the flame to provide additional ignition energy to the incoming fuel to stabilize the flame.

Preferably, the plate means comprises first and second splitter plates disposed within the inner shell with their leading edge portion dispoed transversely across the flow passageway of the inner shell at the inlet thereof and their trailing edge portion extending transversely across the flow passageway of the inner shell at the outlet end thereof. The first and second splitter plates converge along a line at the inlet end of the inner shell and extend outwardly therefrom in a diverging manner toward the outlet end of the inner shell. In this manner, the first and second splitter plates divide the flow passageway through the inner shell into a first flow passage bounded by the first splitter plate and the inner shell and a second flow passage bounded by the second splitter plate and the inner shell. The first and second flow passages diverge in the direction of flow through the nozzle tip and are separated by a void region established between the first and second divergent splitter plates through which flow is precluded. Accordingly, a low pressure recirculation zone will be established in the furnace just downstream of the void region of the nozzle tip between the diverging fuel-air streams as they discharge into the furnace from the divergent first and second flow passages through the inner shell.

Further in accordance with the present invention, ignition stability may be further enhanced by providing splitter plates having their trailing edge portion scalloped. The trailing edge portion of a splitter plate is preferably scalloped by forming the trailing edge portion of the splitter plate of a plurality of longitudinally elongated strips which extend longitudinally outward from the leading edge portion of the splitter plate in side-by-side relationship transversely across the flow passageway through the inner shell. A first portion of the trailing edge strips, disposed alternately between a second portion of the trailing edge strips, is bent radially away from the leading edge of the splitter plate in one direction while the second portion of the trailing edge strips is bent radially away from the leading edge portion of the splitter plate in a direction opposite to that in which the first portion of the trailing edge strips are bent away from the leading edge portion of the splitter plate. In this manner, a scalloped edge is provided along the trailing edge portion of the splitter plates which serves to generate turbulence along the boundries between the fuel-air streams discharging from the divergent flow passages and the void region established therebetween whereby the mixing of pulverized fuel and hot combustion products drawn into the low pressure recirculation zone formed in the furnace just downstream of the void region of the nozzle tip thereby further stabilizing ignition.

DESCRIPTION OF THE PREFERRED EMBODIMENT

Figure 1:
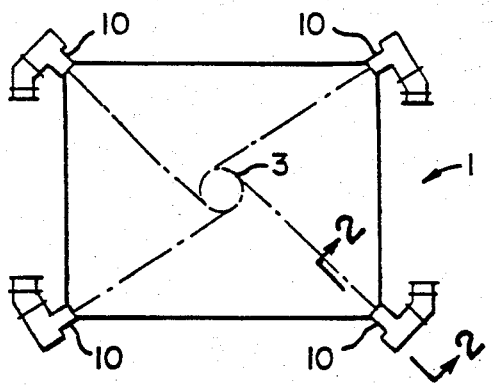
FIG. 1 is a diagrammatic plan view of a furnace employing the tangential firing method.

While the present invention may be applied, in spirit and in scope, to a number of different burner designs employed in the various firing methods commonly used in conventional pulverized fuel-fired steam generator boiler furnaces, it may be best described when embodied on a pulverized coal-air admission assembly of the type employed in pulverized coal fired furnaces utilizing the tangential firing method illustrated in FIG. 1. In the tangential firing method, pulverized coal and air are introduced into the furnace through coal-air admission assemblies 10 mounted in the four corners of the furnace 1. The coal-air admission assemblies 10 are oriented so as to deliver the pulverized coal and air streams tangentially to an imaginary circle 3 in the center of the furnace 1 so as to form therein a rotating vortex-like flame termed a fire ball.

Figure 2:
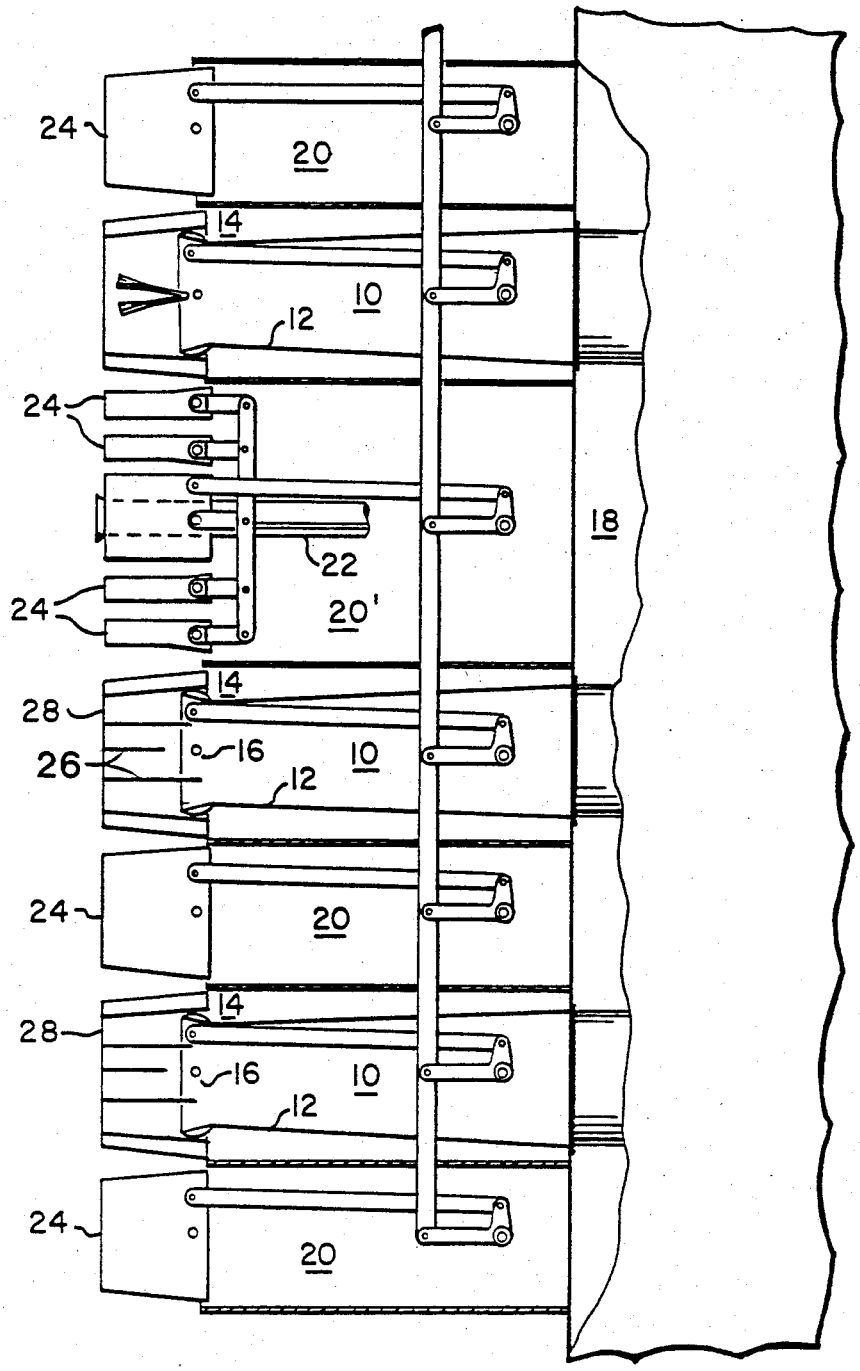
FIG. 2 is a elevational cross-sectional view taken along line 2—2 of FIG. 1, showing a set of three coal-air admission assemblies, the upper coal-air admission assemblied having a nozzle tip designed in accordance with the present invention and the lower two coal-air admission assemblied equipped with a nozzle tip typical of the prior art.

As shown in FIG. 2, a plurality of coal-air admission assemblies 10 are arranged in the corners of the furnace in a vertical column separated by auxiliary air compartments 20 and 20'. One or more of thes auxiliary air compartments, such as compartment 20', is adapted to accomodate an oil or gas burner 22, which is used when starting and warming up the boiler and which, in the prior art, is used when necessary to provide additional ignition energy to stabilize the coal flame when operating the furnace at low loads.

Each coal-air admission assembly 10 comprises a coal delivery pipe 12 extending therethrough and opening into the furnace, and a secondary air conduit 14 which surrounds coal delivery pipe 12 and opens into an air supply plenum 18, termed a windbox. Pulverized coal entrained in transport air is discharged into the furnace through the coal delivery pipes 12 from a supply source such as a pulverizer wherein the coal is dried and comminuted. Secondary air is passed into the furnace through the secondary air conduits 14 as a stream surrounding the pulverized coal and transport air stream discharged from each coal delivery pipe 12. Additional combustion air is passed into the furnace from windbox 18 through the auxiliary air compartments 20.

Each coal delivery pipe 12 is provided with a nozzle tip, often referred to as a coal bucket, which is pivotally mounted to the coal delivery pipe 12 so that the nozzle tip may be tilted about an axis 16 transverse to the longitudinal axis of the coal delivery pipe 12 in order to direct the pulverized coal and air mixture into the furnace at either an upward angle or a downward angle as a means of controlling the position of the fire ball within the furnace whereby the temperature of the superheat steam leaving the steam generator, not shown, is controlled in the manner taught by U.S. Pat. No. 2,363,875 issued Nov. 28, 1944 to Kreisinger et al for "Combustion Zone Control". Nozzle tips 28, shown in FIG. 2, are typical of the standard prior art nozzle tip commonly mounted to the coal delivery pipe 12.

The typical prior art nozzle tip 28 is comprised of a open-ended inner shell defining therethrough a flow passageway through which the mixture of pulverized coal and transport air passses from the coal delivery pipe 12 into the furnace surrounded by an open-ended outer shell spaced therefrom so as to define an annular flow passage therebetween through which secondary air passes from the secondary air conduit 14 into the furnace. The inner and outer shell are adapted to be mounted to the outlet end of the coal delivery pipe 12 by means of a pivot pin so as to be tiltable about axis 16. Typically, one or more baffle plates 26 are disposed within the inner shell of the prior art nozzle tip 28 along an axis parallel to the nozzle tip and the coal delivery pipe 12 so as to form two or more parallel flow passages within the inner shell through which the pulverized coal and air passes from the coal delivery pipe 12 into the furnace as a single stream subdivided into one or more parallel and contiguous substreams. As indicated earlier, when a furnace equipped with the prior art nozzle tips 28 was operated at low load, ignition became unstable and supplemental fuel, such a natural gas or oil, had to be fired in order to provide sufficient additional ignition energy to stabilize the ignition of the single coal-air streams discharging from nozzle tips 28.

Figure 3:
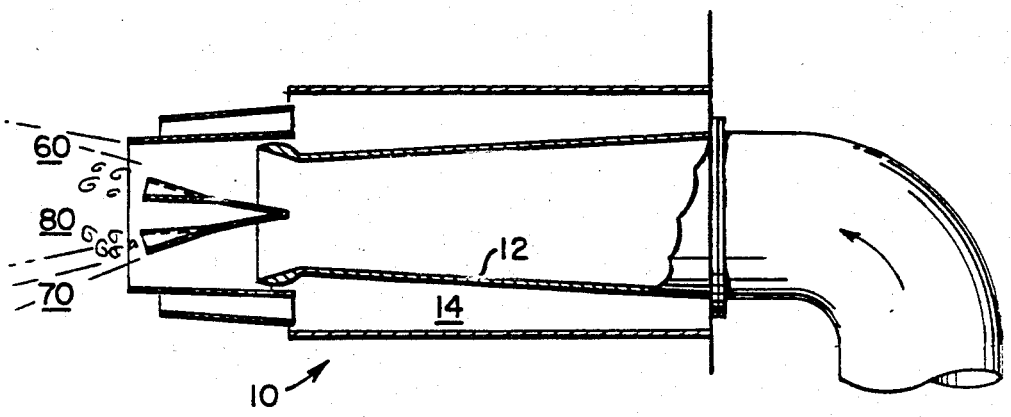
FIG. 3 is a elevational cross-sectional view of a single coal-air admission assembly equipped with a nozzle tip designed in accordance with the present invention.

In accordance with the present invention, stable ignition at low loads is insured by providing a nozzle tip 30 which inherently provides improved ignition stability during low load operation. Nozzle tip 30 comprises an open-ended inner shell 32, an open-ended outer shell 34 spaced from and surrounding the inner shell 32, and plate means 40 disposed within the inner shell for dividing the interior of the inner shell into first and second flow passageway. The inner shell 32 has an outlet end 36 opening into the furnace and an inlet end 38 adapted to be mounted about the outlet end of the coal delivery pipe 12 so as to receive the pulverized coal and air discharging therefrom. An annular flow passageway 50 is defined between the inner shell 32 and the outer shell 34 through which additional combustion air passes from the secondary air conduit 14 into the furnace. In accordance with the present invention, plate means 40 is disposed within the inner shell 32 for dividing the flow passage therethrough into first and second flow passages 52 and 54, respectively, extending from the inlet end 38 of the inner shell 32 to the outlet end 36 thereof in a diverging manner with a void region 56 established therebetween through which flow is precluded. The nozzle tip accomplishes the desired objective of improving ignition stability at low load operation by providing two separate and distinct diverging flow passages 52 and 54 through the inner shell 32 which are spaced to lie above and below a central void 56 through which flow is precluded. As is evident from the drawing, the stream of pulverized fuel and transport air discharging from the coal delivery pipe 12 into the nozzle tip 30 will be split into two portions. One portion would pass into the furnace through the first flow passage 52 of the nozzle tip 30 to be discharged upwardly into the furnace while the second portion of the pulverized coal and transport air stream would pass into the furnace through the second flow passage 54 of the nozzle tip 30 to discharge downwardly into the furnace as best seen in FIG. 3. A low pressure zone 80, which serves as an ignition stabilizing region, will be created in the furnace at the outlet of the nozzle tip 30 downstream of the void region 56 between the diverging coal-air streams 60 and 70. Coal particles from the streams 60 and 70 will be drawn into the low pressure zone 80 from the diverging coal-air streams 60 and 70. Ignition will be stabilized because a portion of the hot combustion products formed during the ignition process are recirculated within the low pressure ignition stabilizing zone 80, thereby providing sufficient ignition energy for igniting coal particles which are subsequently drawn into the zone 80 from the diverging coal-air streams 60 and 70.

In the preferred embodiment of the present invention, the plate means 40 comprises first and second splitter plates 41 and 42 disposed within the inner shell 32 so as to divide the interior of the inner shell 32 into a first flow passage 52 bounded by the first splitter plate 41 and the inner shell 32 and a second flow passage 54 bounded by the second splitter plate 42 and the inner shell 32. Each of the splitter plates 41 and 42 has a leading edge portion 43 disposed transversely across the flow passage of the inner shell 32 at the inlet end 38 thereof and a trailing edge portion 44 extending transversely across the flow passage of the inner shell 32 at the outlet end 36 thereof. The first and second splitter plates 41 and 42 converge along the line at the inlet end 38 of the inner shell 32 and extend outwardly therefrom in a diverging manner, preferably at an included angle of approximately 20°, toward the outlet end 36 of the inner shell 32 and defined therebetween a void region 56 through which flow is precluded.

Figure 4:
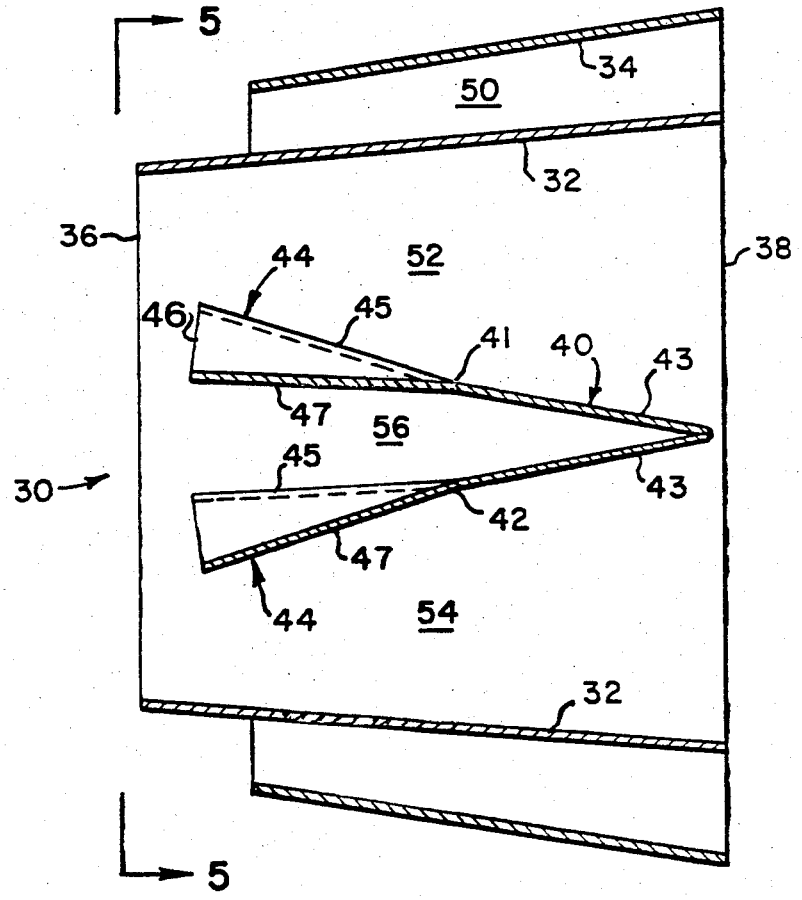
FIG. 4 shows an elevational cross-sectional view of a nozzle tip of the present invention.
Figure 5:
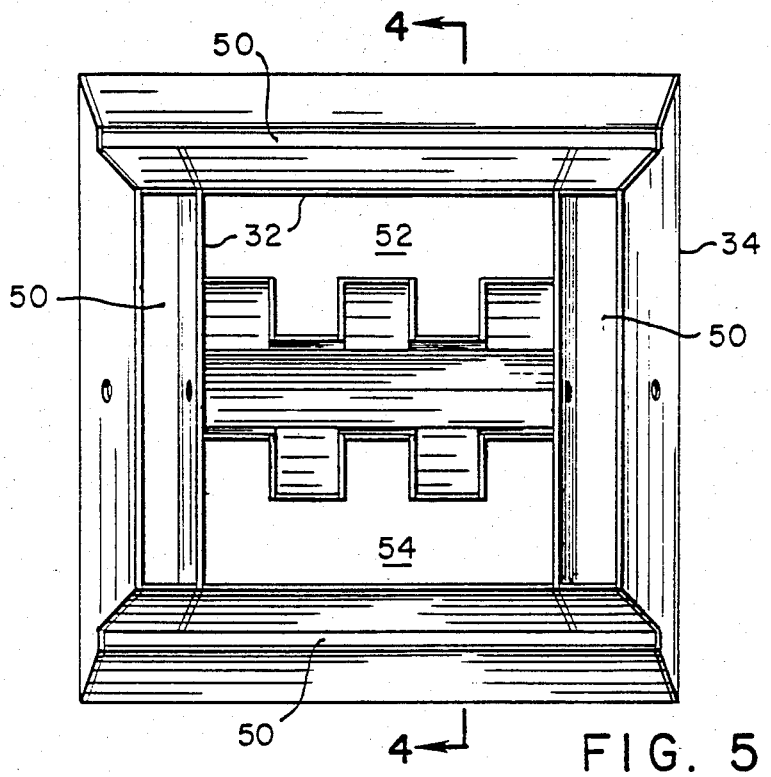
FIG. 5 shows an elevational end view taken along line 5—5 of FIG. 4 of the nozzle tip of the present invention.
Figure 6:
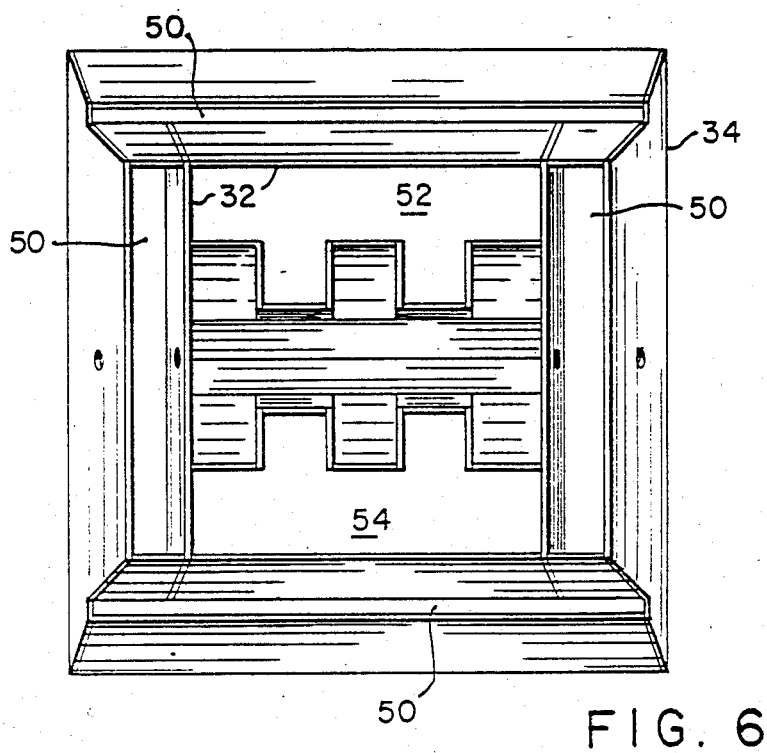
FIG. 6 is an elevational end view of an alternate embodiment of the nozzle tip of the present invention.

Achievement of the objective of improving ignition stability may be further enhanced by providing that the trailing edge portion 44 of the first and second splitter plates 41 and 42 is scalloped as best seen in FIGS. 4, 5 and 6. To scallop the trailing edge portion 44 of each of the first and second splitter plates 41 and 42, the trailing edge portion 44 thereof comprises a plurality of longitudinally elongated strips extending longitudinally outward from the leading edge portion 43 of the splitter plates in side-by-side relationship transversely across the flow passageway of the inner shell 32. A first portion 45 of the trailing edge strips extending longitudinally outward from the leading edge portion of the first and second splitter plates is disposed alternately across the inner shell 32 between a second portion 47 of the trailing edge strips and are bent radially away from the second portion 47 of the trailing edge strips thereby forming the desired scalloped trailing edge on the splitter plates 41 and 42. Preferably, the first portion 45 of the trailing edge strips are bent radially away from the leading edge portion 43 of each splitter plate in one direction while the second portion 47 of the trailing edge strips is bent radially away from the leading edge portion 43 of each of the splitter plates in the direction opposite to that in which the first portion 45 are bent.

By providing a scalloped trailing edge portion on each of the splitter plates 41 and 42, a turbulent zone is established along the interface between each of the coal-air streams 60 and 70 in the low pressure recirculation zone 80 formed therebetween. Such a turbulent interface insures that coal and air will be drawn out of the coal-air streams and mixed thoroughly with hot ignition products in the low pressure recirculation zone 80 thereby further enhancing ignition stability.

It is also preferable to provide filler plates 46 which extend transversely between adjacent first and second portions 45 and 47 of the trailing edge strips along the interface between the trailing edge strips, as best seen in FIGS. 5 and 6, to preclude the flow of pulverized fuel and transport air across the interface formed between adjacent diverging leading edge strips 45 and 47. If a significant amount of pulverized fuel and transport air were allowed to pass into the void region 56 through the divergent trailing edge strips 45 and 47, the establishment of a low pressure recirculation zone between the diverging coal-air streams 60 and 70 could be adversely affected. Additionally, the splitter plates 41 and 42 may be arranged within the inner shell 32 of the nozzle tip 30 so that the scalloped trailing edge portions thereof are disposed in an in-line arrangement as shown in FIG. 5 or a staggered arrangement as shown in FIG. 6.

Although the splitter plates 41 and 42 are shown in the drawing as being fabricated of various pieces of plate metal welded together, it is to be understood that the splitter plates 41 and 42 may also be readily manufactured by well-known casting processes. Additionally, it is to be appreciated that the lifetime of the splitter plates within the coal flow passage through the inner shell 32 may be enhanced in accordance with the teachings of U.S. Pat. No. 4,356,975 issued Nov. 2, 1982 to Chadshay for "Nozzle Tip for Pulverized Coal Burner" by manufacturing the splitter plates 41 and 42 with their leading edge portion 43 formed of a relatively abrasion resistant material such as silicon carbide or Ni-hard, and their trailing edge portion 44 formed of a material relatively resistant to high temperatures such as certain wellknown stainless steels.

While the preferred embodiment of the present invention has been illustrated and described when incorporated into a coal-air admission assembly of the type typically employed on a tangentially-fired furnace, it is to be understood that the invention should not be limited thereto. The nozzle tip of the present invention could be readily modified by those skilled in the art to be applied within the spirit and scope of the present invention to any number of burner configurations wherein pulverized coal or other abrasive pulverized solids are to be combusted.

I claim:

1. A nozzle tip for a burner on a pulverized fuel fired furnace comprising:

a. an open-ended inner shell having an inlet end and an outlet end and defining therebetween a flow passageway through which a mixture of pulverized fuel and transport air passes from the burner into the furnace;

b. an open-ended outer shell spaced from and surrounding said inner shell thereby defining an annular flow passageway therebetween through which additional air passes from the burner into the furnace; and c. first and second splitter plates disposed within said inner shell, each having a leading edge portion disposed transversely across the flow passageway of said inner shell at the inlet end thereof and a trailing edge portion extending transversely across the flow passageway of said inner shell at the outlet end thereof, said first and second splitter plates converging at the inlet end of said inner shell and extending outwardly therefrom in a diverging manner toward the outlet end of said inner shell, said first and second splitter plates thereby dividing the flow passageway through said inner shell into a first flow passage bounded by the first splitter plate and said inner shell and a second flow passage bounded by the second splitter plate and said inner shell, said first and second flow passages diverging in the direction of flow through the nozzle tip and being spaced apart at the outlet end of the nozzle tip so as to establish a void region therebetween through which flow directly from the nozzle tip is precluded, the trailing edge portion of each of said first and second splitter plates being formed of a plurality of longitudinally elongated strips extending longitudinally outward from the leading edge portion of each of said first and second splitter plates in a side-by-side relationship transversely across the flow passageway of said inner shell, a first portion of said trailing edge strips disposed alternately between a second portion of said trailing edge strips and bent radially away from the leading edge portion of each of said first and second splitter plates thereby forming a scalloped tailing edge portion of each of said first and second splitter plates.

2. A nozzle tip as recited in claim 1 wherein the second portion of said trailing edge strips is bent radially away from the leading edge portion of each of said first and second splitter plates in the direction opposite to that in which the first portion of said trailing edge strips are bent radially away from the leading edge portion of each of said first and second splitter plates.

3. A nozzle tip as recited in claim 1 further comprising a plurality of filler plates disposed transversely between adjacent first and second portions of said trailing edge strips along the interface therebetween thereby precluding the flow of pulverized fuel and transport air across the interface formed between adjacent diverging first and second portions of said trailing edge strips.

4. A nozzle tip as recited in claim 1 wherein the leading edge portions of said first and second splitter plates diverge at an included angle of approximately twenty degrees.

* * * * *